US008441374B2

(12) United States Patent
Yokoyama et al.

(10) Patent No.: US 8,441,374 B2
(45) Date of Patent: May 14, 2013

(54) TRAVELING SUPPORT DEVICE AND TRAVELING SUPPORT METHOD

(75) Inventors: Akihisa Yokoyama, Susono (JP); Takeshi Matsumura, Susono (JP); Mitsuhisa Shida, Fuji (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 457 days.

(21) Appl. No.: 12/922,343

(22) PCT Filed: Mar. 12, 2009

(86) PCT No.: PCT/IB2009/000532

§ 371 (c)(1),
(2), (4) Date: Sep. 13, 2010

(87) PCT Pub. No.: WO2009/112943

PCT Pub. Date: Sep. 17, 2009

(65) Prior Publication Data

US 2011/0001634 A1 Jan. 6, 2011

(30) Foreign Application Priority Data

Mar. 12, 2008 (JP) ..... 2008-063115

(51) Int. Cl.
*G08G 1/096* (2006.01)

(52) U.S. Cl.
USPC ..... 340/929; 340/905; 340/907; 340/916; 340/932; 340/995.13; 701/117

(58) Field of Classification Search ..... 340/905, 340/907, 916, 929, 932, 995.13; 701/117
See application file for complete search history.

(56) References Cited

U.S. PATENT DOCUMENTS 5,204,536 A * 4/1993 Vardi ..... 250/551
5,428,544 A * 6/1995 Shyu ..... 701/117

(Continued)

FOREIGN PATENT DOCUMENTS

DE 100 28 130 12/2001
DE 601 06 794 T2 11/2005

(Continued)

OTHER PUBLICATIONS

Office Action issued Nov. 14, 2011 in German Application No. DE 11 2009 000 603.5 (With English Translation).

(Continued)

*Primary Examiner* — Jennifer Mehmood
*Assistant Examiner* — Andrew Bee
(74) *Attorney, Agent, or Firm* — Oblon, Spivak, McClelland, Maier & Neustadt, L.L.P.

(57) ABSTRACT

A traveling support device includes: a road-vehicle communication portion that receives first current-signal information relating to a signal displayed by a traffic signal at a first clock time, from a road side transmitter installed on a road; an inter-vehicle communication portion that receives second current-signal information relating to a signal displayed by the traffic signal at a second clock time, from another vehicle that receives the second current-signal information from the road side transmitter; and a signal cycle estimating portion that estimates signal cycle information relating to transition of the signal on the traffic signal on the basis of the first current-signal information received by the road-vehicle communication portion and the second current-signal information received by the inter-vehicle communication portion.

8 Claims, 8 Drawing Sheets

U.S. PATENT DOCUMENTS

| | | | | |
|---|---|---|---|---|
| 6,516,262 | B2 * | 2/2003 | Takenaga et al. | 701/96 |
| 7,764,194 | B2 * | 7/2010 | Osanai | 340/907 |
| 2005/0187701 | A1 | 8/2005 | Baney | |
| 2005/0226158 | A1 | 10/2005 | Takahashi et al. | |
| 2006/0119489 | A1 * | 6/2006 | Shinada et al. | 340/901 |
| 2007/0229310 | A1 | 10/2007 | Sato | |
| 2008/0030372 | A1 | 2/2008 | Lu | |

FOREIGN PATENT DOCUMENTS

| | | |
|---|---|---|
| EP | 1 127 727 B1 | 8/2001 |
| JP | 2000 306194 | 11/2000 |
| JP | 2004 171459 | 6/2004 |
| JP | 2005 147884 | 6/2005 |

OTHER PUBLICATIONS

International Search Report issued Jun. 22, 2009 in PCT/IB09/000532 filed Mar. 12, 2009.

* cited by examiner

TRAVELING SUPPORT DEVICE AND TRAVELING SUPPORT METHOD

BACKGROUND OF THE INVENTION

1. Field of the Invention

This invention relates to a traveling support device and traveling support method, and particularly to a traveling support device which receives information relating to a signal displayed by a traffic signal at each clock time, and estimates, based on the received information, signal cycle information that is information relating to transition of the signal of the traffic signal.

2. Description of the Related Art

Information on a signal of a traffic signal is provided to a vehicle by a road side transmitter installed on a road, such as an optical beacon. For example, Japanese Patent Application Publication No. 2004-171459 (JP-A-2004-171459) discloses a technology in which a DSRC transmitter for transmitting traffic signal information (signal position ID, a lighting time interval of each lighting color, the color of the light that is being lighted currently, elapsed time, direction, and type of signal) is provided on a traffic signal, an on-vehicle machine (traveling support device) is mounted in a vehicle, traffic signal information is received by a DSRC receiver, and the lighting state and change timing of the traffic signal are determined from the received information and displayed on a display device. According to this technology, a driver can travel the vehicle after recognizing the time until the lighting state of the traffic signal changes.

In this technology, signal cycle information including a lighting time interval of each lighting color and the color of the light that is being lighted currently is transmitted as traffic signal information from the DSRC transmitter of the traffic signal. Therefore, the traveling support device can support traveling of the vehicle based on the signal cycle information. However, the traveling support device may receive, from the road side transmitter, only current-signal information relating to the color of the light that is being lighted currently by the traffic signal, and consequently the vehicle might reach an intersection or the like that has a traffic signal. Because the information relating to a signal corresponding to time other than the current clock time cannot be obtained in such a case, the traveling support device might not be able to support the traveling of the vehicle effectively. On the other hand, although the signal cycle information might be estimated from the current-signal information corresponding only to the current clock time, the accuracy of such estimation might not satisfy the requirements.

SUMMARY OF THE INVENTION

The invention provides a traveling support device and traveling support method that more accurately estimate signal cycle information of a traffic signal from current-signal information relating to a signal displayed by the traffic signal at each clock time.

A first aspect of the invention is a traveling support device, which has: road-vehicle communication means for receiving first current-signal information relating to a signal displayed by a traffic signal at a first clock time, from a road side transmitter installed on a road; inter-vehicle communication means for receiving second current-signal information relating to a signal displayed by the traffic signal at a second clock time, from an other vehicle that receives the second current-signal information from the road side transmitter; and signal cycle estimating means for estimating signal cycle information relating to transition of the signal on the traffic signal on the basis of the first current-signal information received by the road-vehicle communication means and the second current-signal information received by the inter-vehicle communication means.

According to this configuration, the road-vehicle communication means receives the first current-signal information relating to a signal displayed by a traffic signal at a first clock time, from the road side transmitter installed on a road, the inter-vehicle communication means receives the second current-signal information relating to a signal displayed by the traffic signal at a second clock time, from another vehicle that receives the second current-signal information from the road side transmitter, and the signal cycle estimating means estimates the signal cycle information relating to transition of the signal on the traffic signal on the basis of the first current-signal information received by the road-vehicle communication means and the second current-signal information received by the inter-vehicle communication means. Therefore, the signal cycle estimating means estimates the signal cycle information based on the current-signal information corresponding to two clock times, which makes it possible to carry out the estimation of the signal cycle information more accurately than estimation performed based on the current-signal information corresponding to one clock time.

There may be a plurality of types of signals displayed by the traffic signal, and the signal cycle estimating means may estimate the signal cycle information by interpolating information relating to a signal that is displayed by the traffic signal at a clock time other than the first clock time and second clock time, on the basis of the first current-signal information, the second current-signal information, and duration time information relating to a display duration time for each of the plurality of types of signals.

According to this configuration, the accuracy of estimating the signal cycle information is further improved, because the information relating to a signal displayed by the traffic signal at a clock time other than the first clock time and second clock time is interpolated based on the duration time information relating to a duration time during which each of the types of signals displayed by the traffic signal is displayed.

The inter-vehicle communication means may transmit the signal cycle information estimated by the signal cycle estimating means, to the other vehicle.

According to this configuration, because the inter-vehicle communication means transmits, to the other vehicle, the signal cycle information estimated by the signal cycle estimating means, the estimated signal cycle information can be shared by the subject vehicle and the other vehicle.

In addition, the inter-vehicle communication means may receive, from the other vehicle which is a following vehicle, the second current-signal information relating to the signal displayed at the second clock time subsequent to the first clock time.

According to this configuration, even when the subject vehicle is a preceding vehicle and when only the first current-signal information corresponding to the first clock time is acquired, the inter-vehicle communication means can receive from the following other vehicle the second current-signal information corresponding to the second clock time subsequent to the first clock time, and estimate the signal cycle information.

Alternatively, the inter-vehicle communication means may receive, from the other vehicle which is a preceding vehicle, the second current-signal information relating to the signal displayed at the second clock time preceding the first clock time.

According to this configuration, even when the subject vehicle is a following vehicle and when only the first current-signal information corresponding to the first clock time is acquired, the inter-vehicle communication means can receive from the preceding other vehicle the second current-signal information corresponding to the second clock time subsequent to the first clock time, and estimate the signal cycle information.

A second aspect of the invention provides a traveling support method. First current-signal information relating to a signal displayed by a traffic signal at a first clock time is received from a road side transmitted installed on a road. Second current-signal information relating to a signal displayed by the traffic signal at a second clock time is received from an other vehicle that receives the second current-signal information from the road side transmitter. Then, signal cycle information relating to transition of the signal on the traffic signal is estimated based on the first current-signal information and the second current-signal information.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

A traveling support device according to an embodiment of the invention is described hereinafter with reference to the accompanying drawings.

Figure 1:
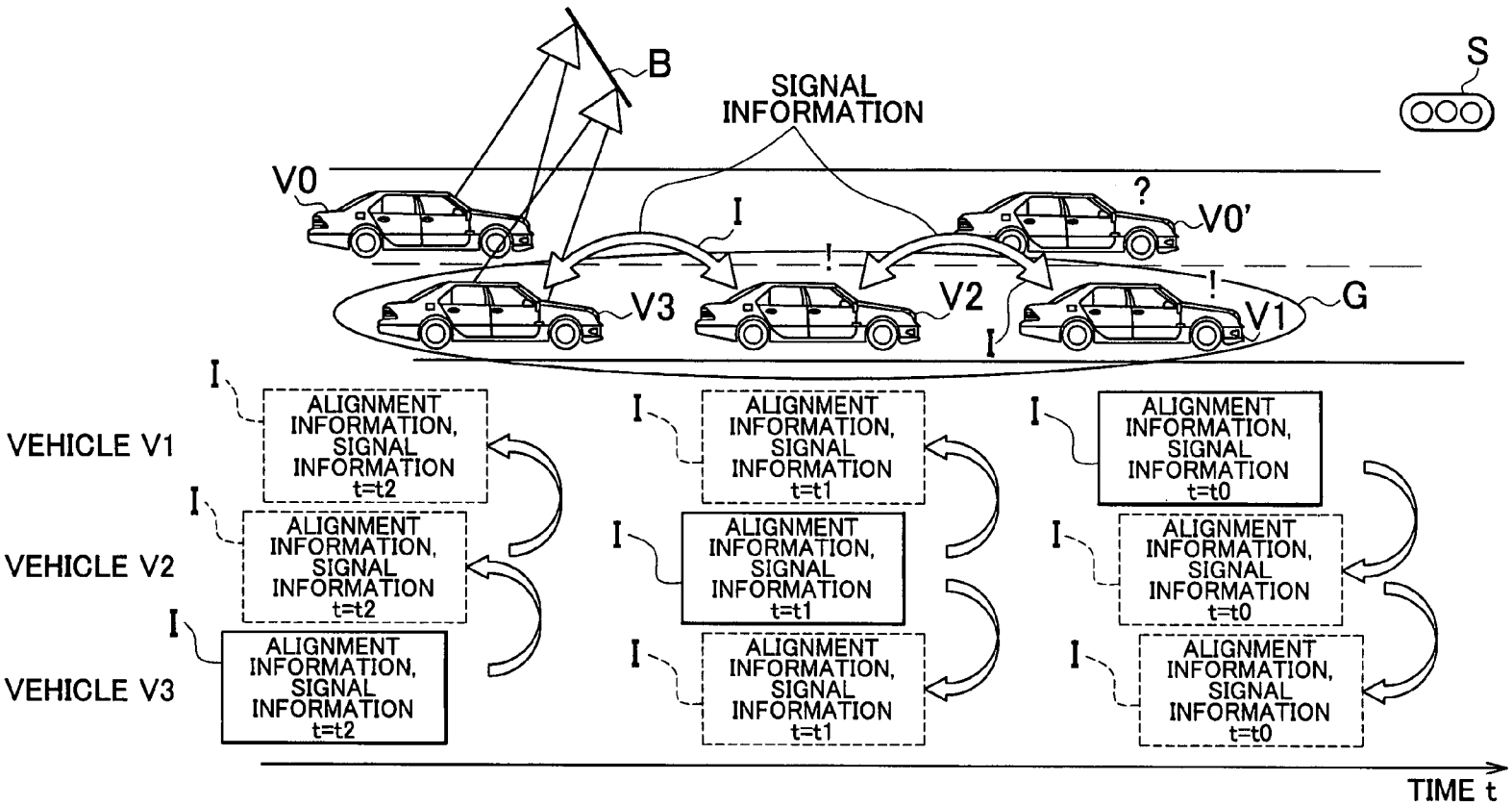
FIG. 1 is a plan view showing a situation to which a traveling support device according to an embodiment of the invention is applied.

FIG. 1 is a plan view showing a situation to which a traveling support device according to an embodiment of the invention is applied. The assumption made in the following description is a situation in which vehicles V1, V2 and V3 that form a vehicle group G travel in a series on a road installed with a traffic signal S and an optical beacon (road side transmitter) B for transmitting current-signal information relating to a signal displayed by the traffic signal S at each clock time as shown in FIG. 1. Each of the vehicles V1, V2 and V3 is equipped with a traveling support device according to the embodiment. For later description, vehicles V0 and V0' without the traveling support device of this embodiment are also illustrated on the road.

Figure 2:
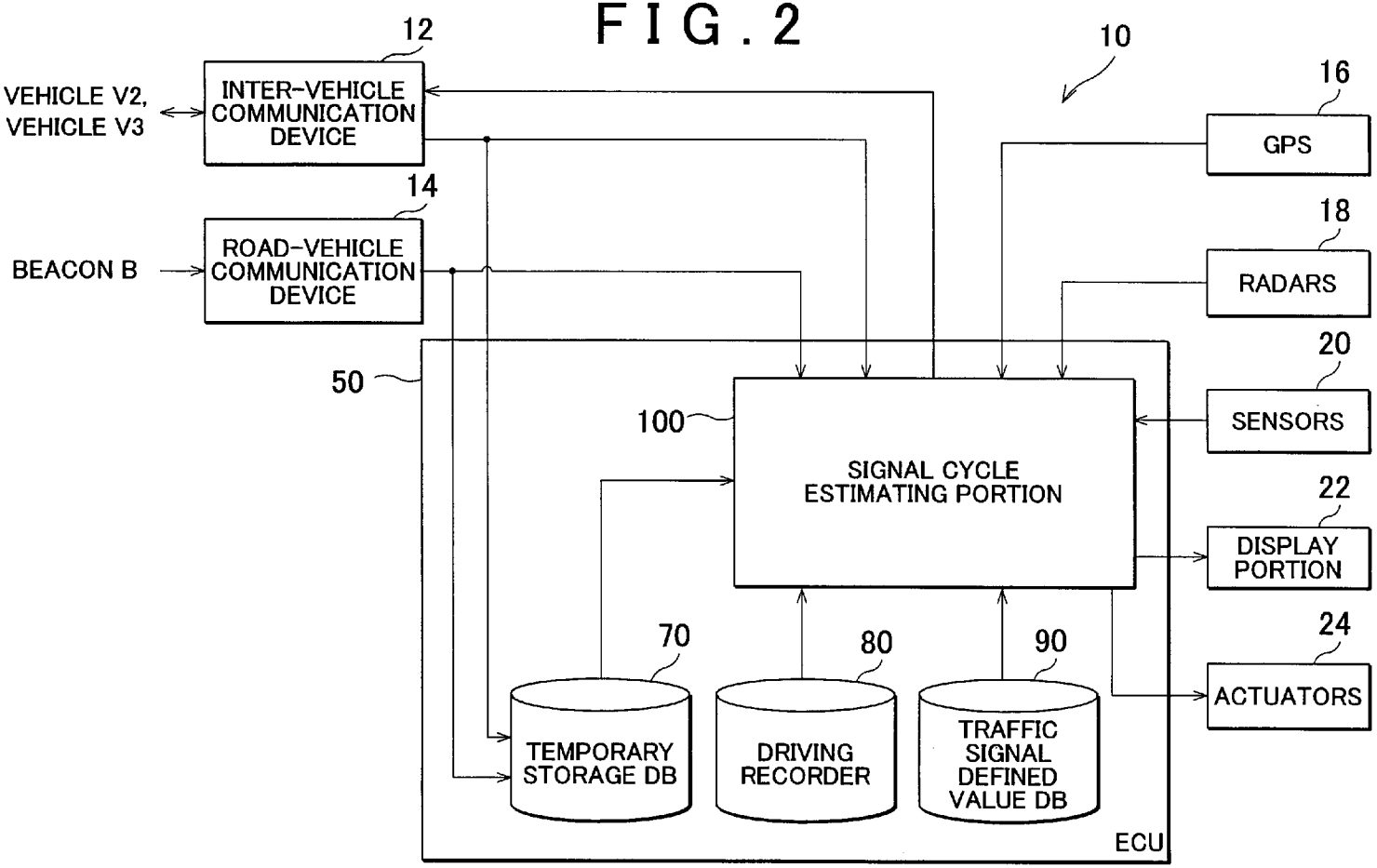
FIG. 2 is a block diagram showing a configuration of the traveling support device according to the embodiment.

FIG. 2 is a block diagram showing a configuration of the traveling support device according to the embodiment. The traveling support device of this embodiment, mounted in each vehicle of the vehicle group, receives current-signal information (first current-signal information) transmitted from the road side transmitter installed on the road, such as the optical beacon, and current-signal information transmitted from another vehicle of the vehicle group (second current-signal information), and estimates signal cycle information based on these current-signal information to support the traveling of the vehicles. In FIG. 2, the traveling support device mounted in the vehicle V1 (subject vehicle) is shown as a representative traveling support device, and the same type of traveling support device is mounted in the vehicles V2 and V3 (other vehicles) as well.

As shown in FIG. 2, in a traveling support device 10 of this embodiment, an inter-vehicle communication device 12, road-vehicle communication device 14, global positioning system (GPS) 16, radars 18, sensors 20, display portion 22, and actuators 24 are connected to an electronic control unit (ECU) 50. The ECU 50 has a temporary storage database (DB) 70, driving recorder 80, traffic signal defined value DB 90, and signal cycle estimating portion 100.

The inter-vehicle communication device 12 performs wireless communication with the other vehicles such as the vehicles V2 and V3, receives from the vehicles V2 and V3 the current-signal information of the traffic signal S acquired from the optical beacon B by the vehicles V2 and V3, and acquires information on whether the other vehicles such as the vehicles V2 and V3 exist around the vehicle V1, information on the inter-vehicle distance between the vehicle V1 and the other vehicles, information on the speed/acceleration of the other vehicles, alignment information relating to road alignments (the position of a stop line, gradient, the number of traffic lanes, and the like) of the road on which the vehicle V1 travels, and traffic information on a traffic jam. The inter-vehicle communication device 12 also transmits the signal cycle information of the traffic signal S estimated by the signal cycle estimating portion 100 of the ECU 50, to the vehicles V2 and V3. The inter-vehicle communication device 12 may be regarded as the inter-vehicle communication means claimed in the invention.

The road-vehicle communication device 14 receives the current-signal information of the traffic signal S that is transmitted in the form of infrared communication from the optical beacon B installed on the road. Alternatively, the road-vehicle communication device 14 acquires, from the optical beacon B, the alignment information or traffic information on the road on which the vehicle V1 travels, the information on whether the other vehicles such as the vehicles V2 and V3 exist around the vehicle V1, the information on the inter-vehicle distance between the vehicle V1 and the other vehicles, and the information on the speed/acceleration of the other vehicles. The road-vehicle communication device 14 may be regarded as the road-vehicle communication means claimed in the invention.

The GPS 16, which is a system for detecting the current position of the vehicle V1 by receiving signals from several satellites overhead by means of a GPS receiver, acquires the current position of the vehicle V1 and the alignment information or traffic information on the road on which the vehicle V1 travels.

The radars 18 are specifically configured by a millimeter-wave radar sensor, camera sensor, and the like, and acquire the information on whether the other vehicles such as the vehicles V2 and V3 exist around the vehicle V1, the information on the distance between the vehicle V1 and the other vehicles, and the information on the speed/acceleration of the other vehicles.

The sensors 20 are specifically configured by an accelerator operation amount detection sensor, vehicle speed sensor, steering sensor, yaw rate sensor, and the like, and detect the speed, acceleration, traveling direction, and yaw rate of the vehicle V1.

The display portion 22 is a liquid crystal display or voice speaker for a navigation system, and displays the signal cycle information estimated by the signal cycle estimating portion 100 of the ECU 50 to a driver of the vehicle V1.

The actuators 24 are basically configured by an accelerator actuator, brake actuator, and steering actuator, and automatically controls the traveling of the vehicle V1 on the basis of the signal cycle information estimated by the signal cycle estimating portion 100 of the ECU 50.

The temporary storage DB 70 of the ECU 50 is a database for temporarily storing the current-signal information acquired from the inter-vehicle communication device 12 and the road-vehicle communication device 14 and other information. The temporary storage DB 70 stores the acquired current-signal information in association with a clock time at which the current-signal information was acquired.

The driving recorder 80 of the ECU 50 is a database for storing a travel route taken by the vehicle V1, the speed of the vehicle V1 traveling the travel route, traveling records such as time required to reach a destination, and traveling tendencies such as whether the traffic signal is passed, whether the vehicle V1 changes the traffic lane, whether the vehicle V1 turns to the right or left, and acceleration of the vehicle V1. In this case, the traveling tendencies of the vehicle V1 may be recorded in the driving recorder 80 such that an ID number or the like is allocated to each driver driving the vehicle V1 to identify him, and the traveling tendencies may be recorded in association with each ID number of the driver.

The traffic signal defined value DB 90 of the ECU 50 is a database for recording the type of signal (lighting color, arrow light) displayed by the traffic signal installed in each area, and tendencies of the display duration time of the signal. In this case, especially the minimum display duration time of each signal (duration time information) is recorded as the display duration time of the signal recorded in the traffic signal defined value DB 90.

The signal cycle estimating portion 100 estimates the signal cycle information relating to transition of the signal displayed by the traffic signal S, based on the current-signal information received by the road-vehicle communication device 14 from the optical beacon B and the current-signal information received by the inter-vehicle communication means from the vehicle V2 and V3. The signal cycle estimating portion 100 may be regarded as the signal cycle estimating means claimed in the invention.

Figure 3:
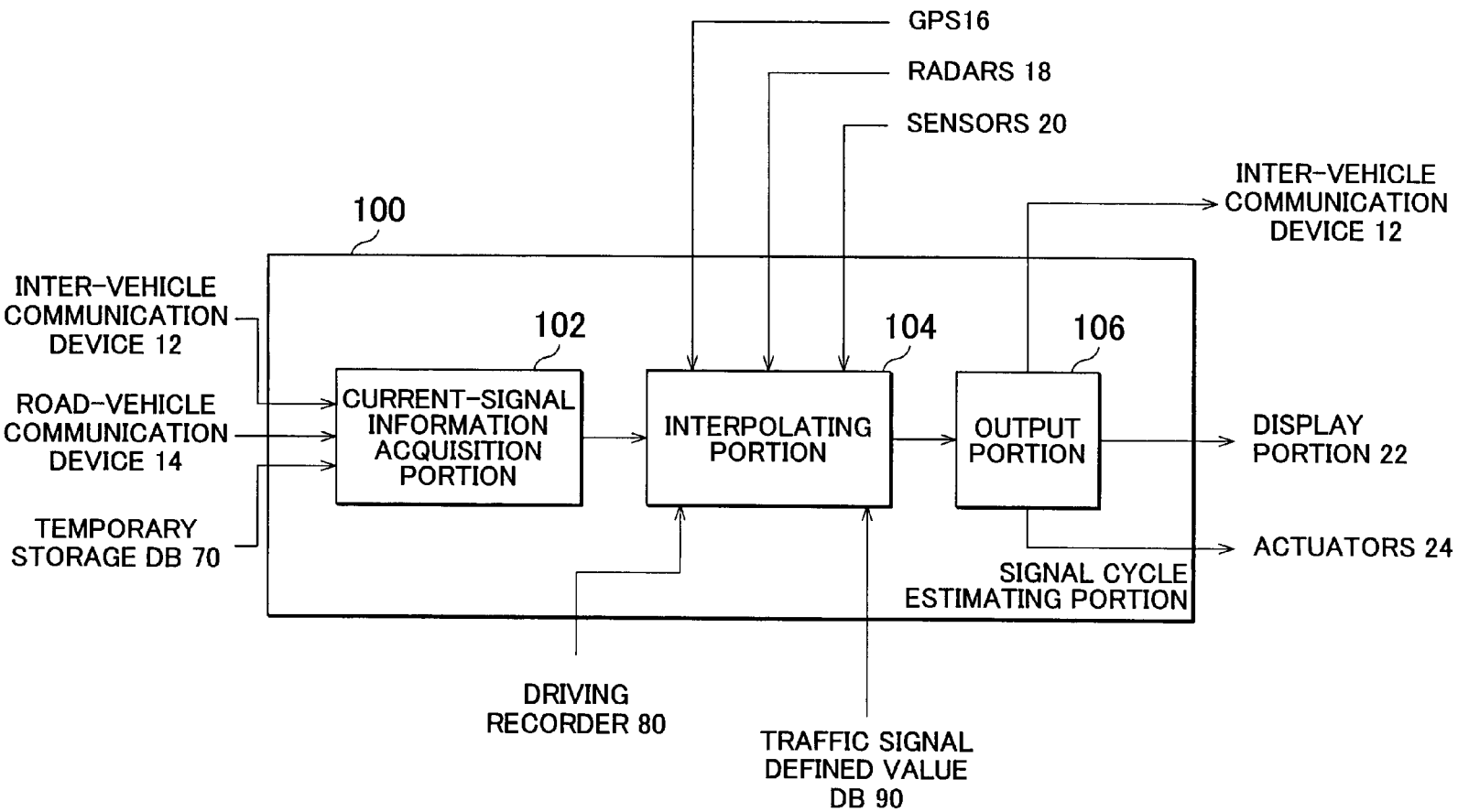
FIG. 3 is a block diagram showing a configuration of a signal cycle estimating portion shown in FIG. 2.

FIG. 3 is a block diagram showing the configuration of the signal cycle estimating portion 100 shown in FIG. 2. As shown in FIG. 3, the signal cycle estimating portion 100 has a current-signal information acquisition portion 102, interpolating portion 104, and output portion 106.

The current-signal information acquisition portion 102 acquires the current-signal information of the traffic signal S acquired at a plurality of clock times, from the inter-vehicle communication device 12, road-vehicle communication device 14, and temporary storage DB 70, in association with these acquisition clock times.

The interpolating portion 104 interpolates the information on the signals displayed by the traffic signal S at a clock time other than each acquisition clock time at which the current-signal information is acquired, based on the current-signal information associated with the acquisition clock times acquired from the current-signal information acquisition portion 102, and various information received from the GPS 16, radars 18, sensors 20, driving recorder 80, and traffic signal defined value DB 90, and then estimates the signal cycle information.

The output portion 106 outputs a signal for causing the display portion 22 to display information for supporting the driving of the driver, and a signal for causing the actuators 24 to automatically control the traveling of the vehicle V1, based on the signal cycle information estimated by the interpolating portion 104. The output portion 106 also outputs a signal for transmitting the signal cycle information estimated by the interpolating portion 104 to the vehicle V2 and V3 via the inter-vehicle communication device 12.

An operation of the traveling support device of this embodiment is described next. First are described the steps of a procedure in which the vehicles V1, V2 and V3 forming the vehicle group G share the current-signal information acquired from the optical beacon B at clock times t=t0, t1 and t2 (t0<t1<t2).

Figure 4:
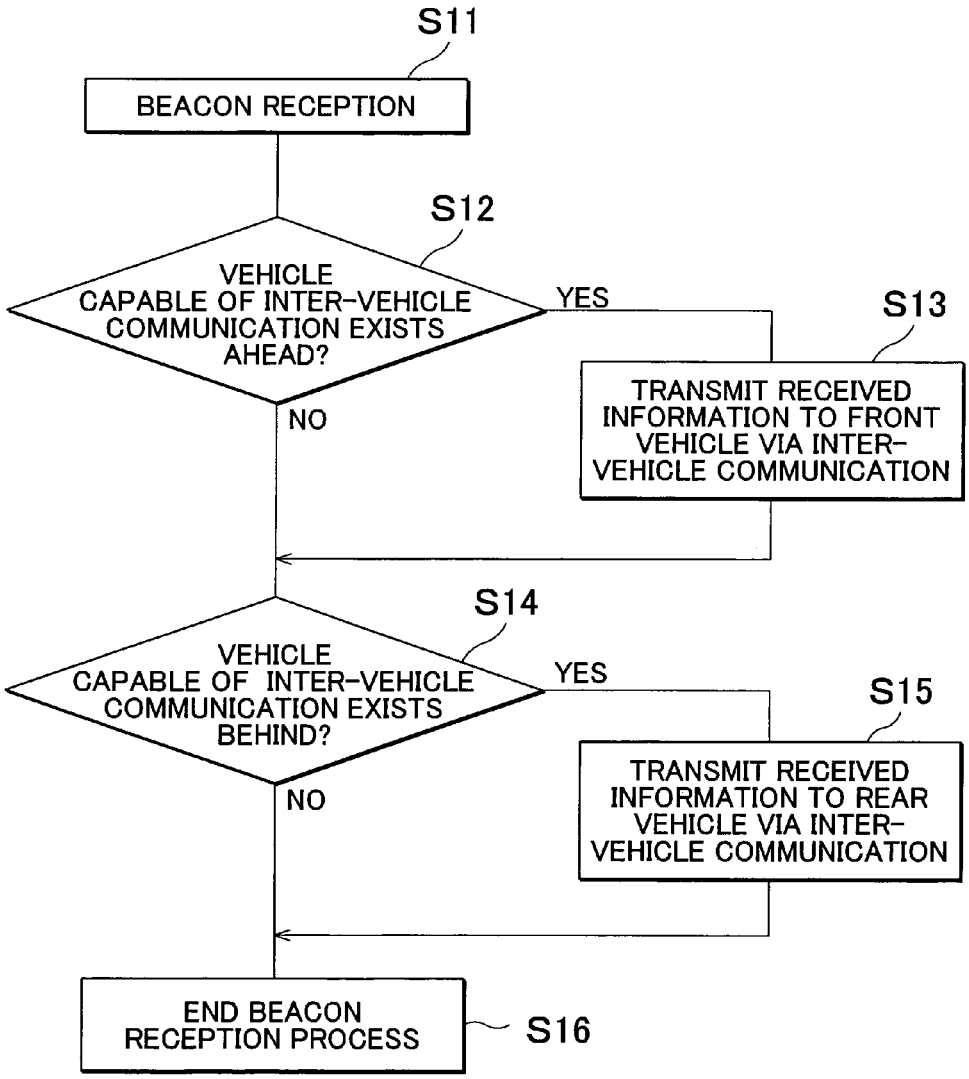
FIG. 4 is a flowchart showing an operation of a vehicle that receives information from a beacon according to the embodiment.

First, the steps of a procedure in which the current-signal information are transmitted from the rearmost vehicle V3 of the vehicle group G are described with reference to FIGS. 4 to 6. As shown in FIGS. 4 and 6, the vehicle V3 receives the current-signal information of the traffic signal S corresponding to t=t2 from the optical beacon B through the road-vehicle communication device 14 (S11). At this moment, the vehicle V3 acquires, through the GPS 16, the alignment information on the road on which the vehicle V3 travels.

From the information acquired from the inter-vehicle communication device 12, road-vehicle communication device 14, and radars 18, the vehicle V3 determines whether a vehicle capable of inter-vehicle communication, that is, a vehicle equipped with the traveling support device 10 of this embodiment, is present in front of the vehicle V3 (S12). In the example shown in FIG. 6, because the vehicle V2 exists in front of the vehicle V3, the vehicle V3 transmits information I including the current-signal information of the traffic signal S corresponding to t=t2 and the alignment information on the road to the vehicle V2 by means of the inter-vehicle communication device 12 (S13).

From the information acquired from the inter-vehicle communication device 12, road-vehicle communication device 14, and radars 18, the vehicle V3 further determines whether a vehicle capable of the inter-vehicle communication, that is, a vehicle equipped with the traveling support device 10 of this embodiment, is present behind the vehicle V3 (S14). In the example shown in FIG. 6, because there is no vehicle behind the vehicle V3, the vehicle V3 ends the process (S16).

Figure 5:
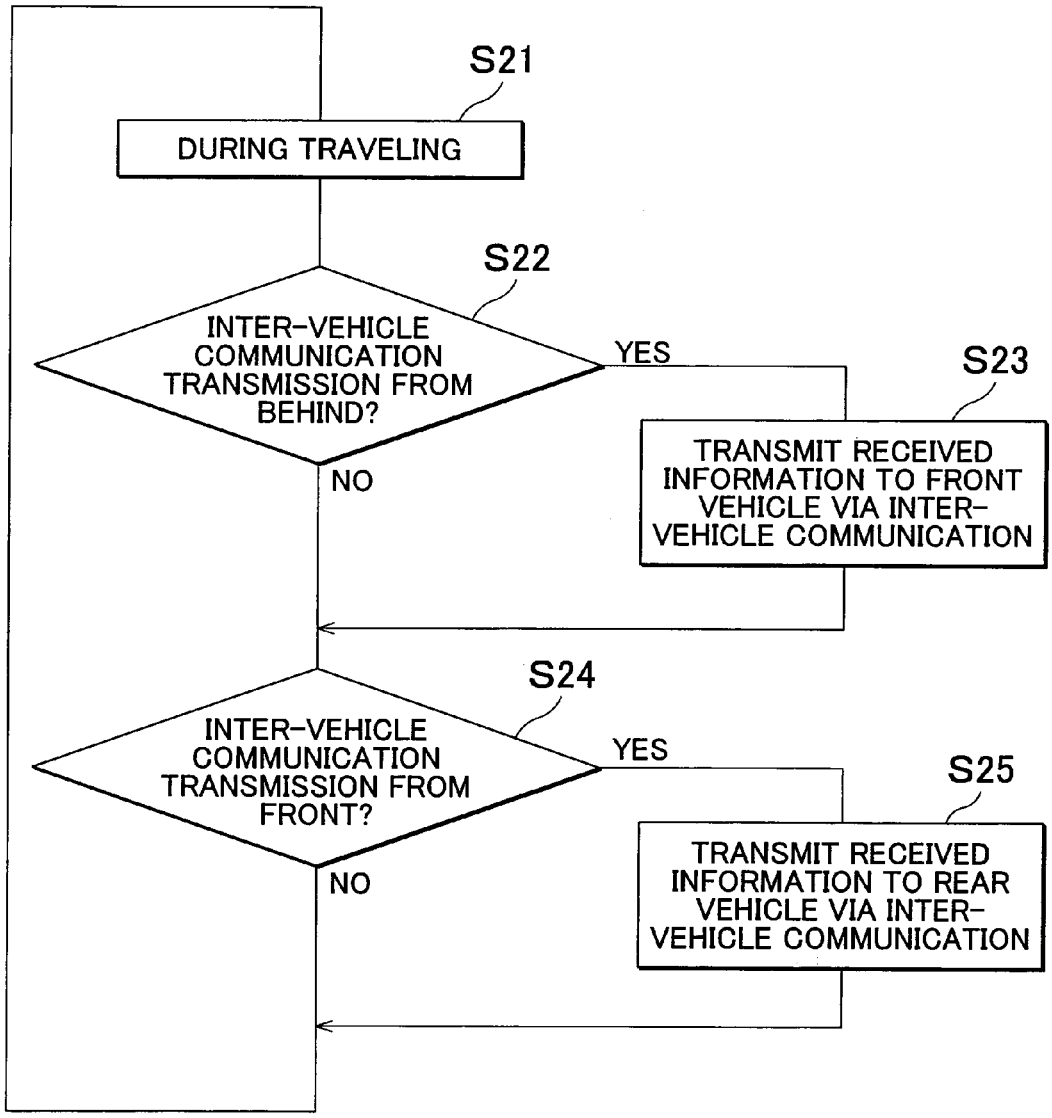
FIG. 5 is a flowchart showing an operation of the vehicle that receives information from another vehicle according to the embodiment.
Figure 6:
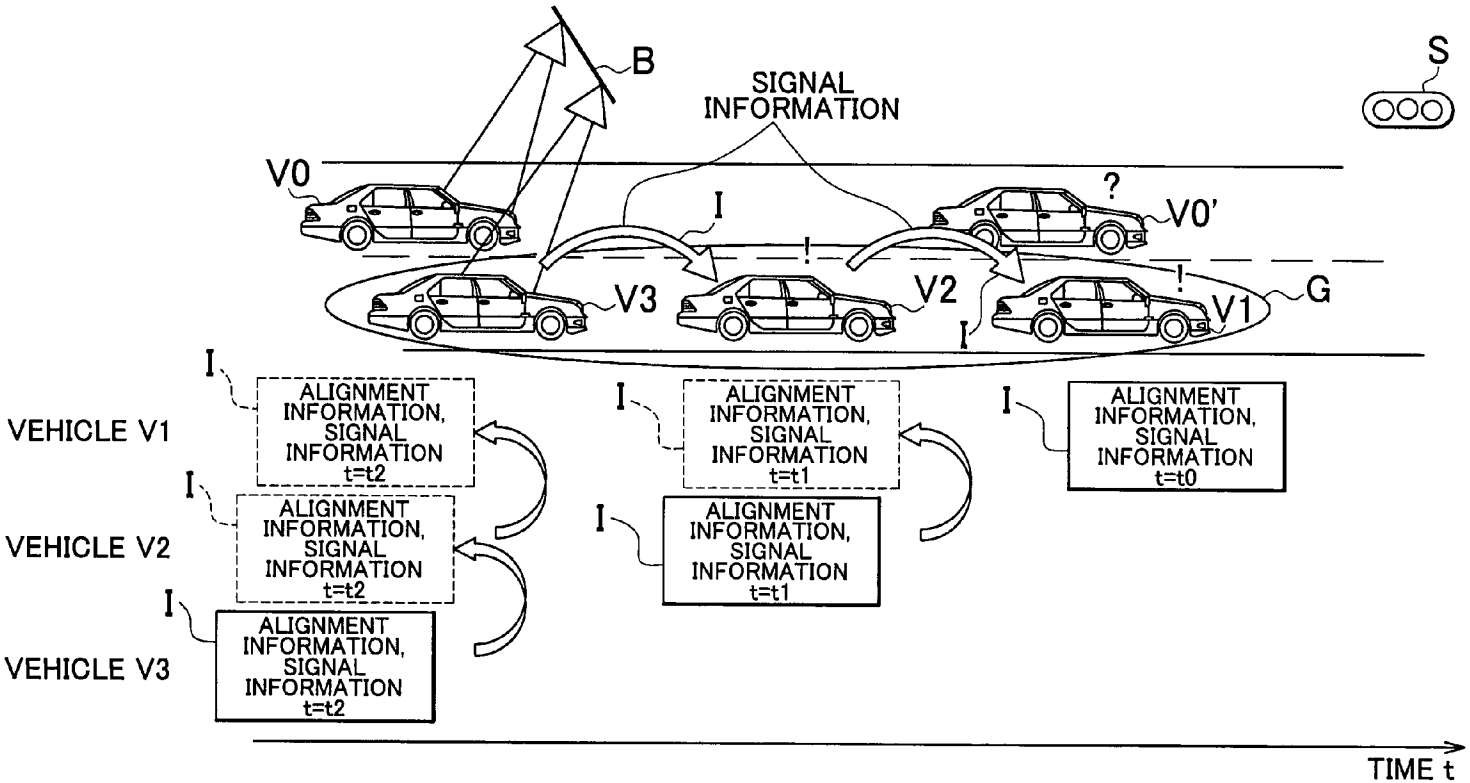
FIG. 6 is a diagram showing how signal information is transmitted from a rear vehicle to a front vehicle according to the embodiment.

As shown in FIGS. 5 and 6, when the vehicle V2 receives, from the vehicle V3 behind, the information I including the current-signal information of the traffic signal S corresponding to t=t2 and the alignment information on the road by means of the inter-vehicle communication device 12 (S22) during the traveling (S21), the vehicle V2 uses the inter-vehicle communication device 12 to transmit, to the front vehicle V1, the information I including the current-signal information of the traffic signal S for t=t2, the current-signal information of the traffic signal S for t=t1 that has been already received by the road-vehicle communication device 14 of its own, and the alignment information on the road (S23). When the vehicle V2 receives from the front vehicle V1 the information I including the current-signal information of the traffic signal S and the alignment information on the road by means of the inter-vehicle communication device 12 (S24), the vehicle V2 transmits the information I to the vehicle V3 behind through the inter-vehicle communication device 12 (S25). In the example shown in FIG. 6, because the information I is not transmitted from the vehicle V1, the vehicle V2 repeats the processes following S21.

As a result, the leading vehicle V1 of the vehicle group G can acquire the current-signal information of the traffic signal S corresponding to t=t1, t2 and the alignment information, in combination with the current-signal information of the traffic signal S corresponding to t=t0 that has been already received by the road-vehicle communication device 14 of its own, as shown in FIG. 6.

Figure 7:
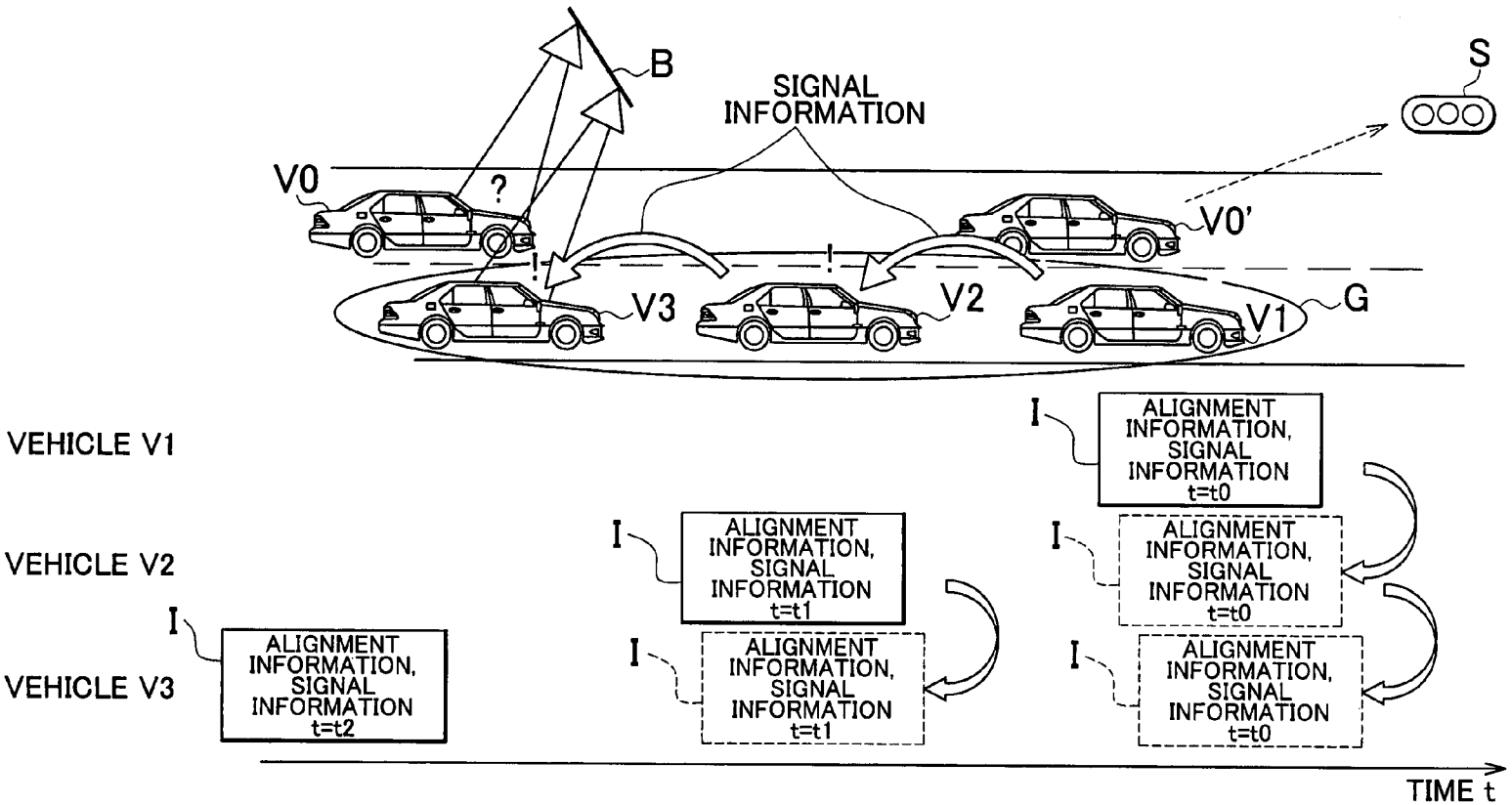
FIG. 7 is a diagram showing how the signal information is transmitted from the front vehicle to the rear vehicle according to the embodiment.

Next, the steps of a procedure in which the current-signal information are transmitted from the leading vehicle V1 of the vehicle group G are described with reference to FIGS. 4, 5 and 7. As shown in FIGS. 4 and 7, the vehicle V1 receives the current-signal information of the traffic signal S from the optical beacon B through the road-vehicle communication device 14 at t=t0 (S11). At this moment, the vehicle V1 acquires, through the GPS 16, the alignment information on the road on which the vehicle V1 travels.

From the information acquired from the inter-vehicle communication device 12, road-vehicle communication device 14, and radars 18, the vehicle V1 determines whether a vehicle capable of inter-vehicle communication, that is, a vehicle equipped with the traveling support device 10 of this embodiment, is present in front of the vehicle V1 (S12). In the example shown in FIG. 7, because there is no vehicle in front of the vehicle V1, the vehicle V1 executes the process of S14.

From the information acquired from the inter-vehicle communication device 12, road-vehicle communication device 14, and radars 18, the vehicle V1 further determines whether a vehicle capable of the inter-vehicle communication, that is, a vehicle equipped with the traveling support device 10 of this embodiment, is present behind the vehicle V1 (S14). In the example shown in FIG. 7, because the vehicle V2 exists behind the vehicle V1, the vehicle V1 transmits the information I including the current-signal information of the traffic signal S for t=t0 and the alignment information on the road to the vehicle V2 by means of the inter-vehicle communication device 12 (S15), and then ends the process (S16).

As shown in FIGS. 5 and 6, when the vehicle V2 receives the information I including the current-signal information of the traffic signal S and the alignment information on the road from the vehicle V3 behind by means of the inter-vehicle communication device 12 (S22) during the traveling (S21), the vehicle V2 uses the inter-vehicle communication device 12 to transmit the information I to the front vehicle V1 (S23). In the example shown in FIG. 7, however, the vehicle V2 executes the process of S24 because the information I is not transmitted from the vehicle V3 behind. When the vehicle V2 receives from the front vehicle V1 the information I including the current-signal information of the traffic signal S corresponding to t=t0 and the alignment information on the road by means of the inter-vehicle communication device 12 (S24), the vehicle V2 uses the inter-vehicle communication device 12 to transmit, to the vehicle V3 behind, the information I including the current-signal information of the traffic signal S corresponding to t=t0, the current-signal information of the traffic signal S corresponding to t=t1 that has been already received by the road-vehicle communication device 14 of it own, and the alignment information on the road (S25), and then repeats the processes following S21.

As a result, the rearmost vehicle V3 of the vehicle group G can acquire the current-signal information of the traffic signal S corresponding to t=t0, t1 and the alignment information, in combination with the current-signal information of the traffic signal S corresponding to t=t2 that has been already received by the road-vehicle communication device 14 of the subject vehicle, as shown in FIG. 7.

By repeating the above processes, the information acquired by the rear vehicle and the information acquired by the front vehicle are relayed in the same direction as shown in FIG. 1, whereby the vehicles V1, V2 and V3 can share and acquire the current-signal information of the traffic signal S corresponding to t=t0, t1 and t2 and the alignment information. Note in the above example that the current-signal information corresponding to each clock time is shared by all of the vehicles V1, V2 and V3 forming the vehicle group G, but only the vehicle that performs the process of estimating the signal cycle information from the current-signal information described hereinafter may be allowed to acquire the current-signal information corresponding to each clock time.

Figure 8:
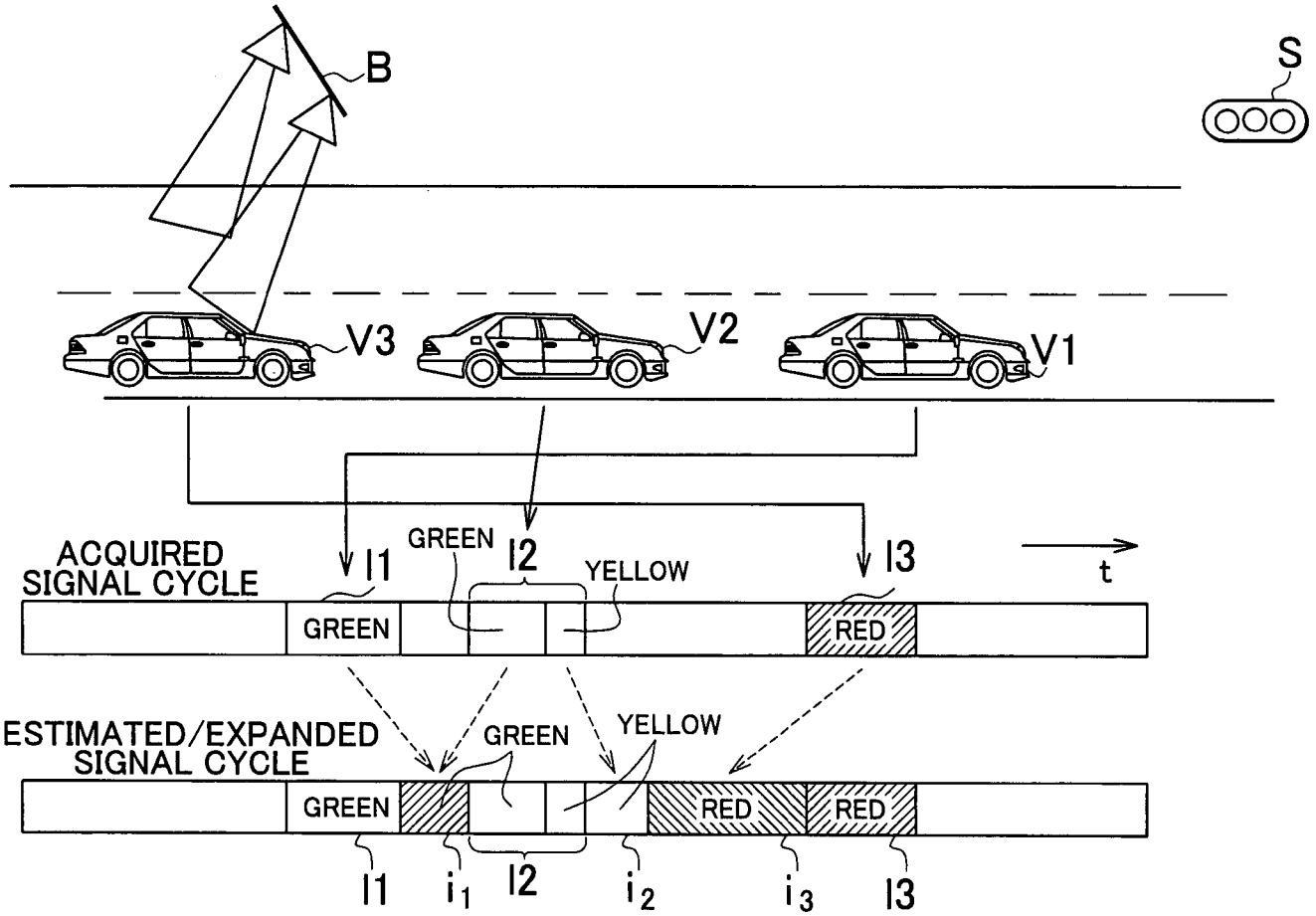
FIG. 8 is a diagram showing a method for interpolating a signal cycle from current-signal information according to the embodiment.

Next, the steps of a procedure for estimating the signal cycle information from the current-signal information corresponding to each clock time are described. FIG. 8 is a diagram showing a method for interpolating a signal cycle from the current-signal information according to the embodiment. As shown in FIG. 8, the current-signal information acquisition portion 102 of the signal cycle estimating portion 100 of the traveling support device 10 mounted in any of the vehicles V1 to V3 collects current-signal information I1 indicating the display duration time of a green signal and acquired by the vehicle V1, current-signal information I2 indicating the display duration times of the green signal and subsequent yellow signal and acquired by the vehicle V2, and current-signal information I3 indicating the display duration time of a red signal and acquired by the vehicle V3.

The interpolating portion 104 of the signal cycle estimating portion 100 interpolates the information between the current-signal information I1, I2 and I3, based on various information from the GPS 16, radars 18, sensors 20, driving recorder 80, and traffic signal defined value DB 90, and particularly the minimum display duration time of each signal recorded in the traffic signal defined value DB 90.

First, the interpolating portion 104 determines whether the time corresponding to an estimation section $i_1$ between the green signal of the current-signal information I1 and the green signal of the current-signal information I2 is equal to or lower than a threshold, the green signals being of the same type. If the time corresponding to the estimation section $i_1$ is equal to or lower than the threshold, the interpolating portion 104 estimates that the green signal is lighted at the time corresponding to the estimation section $i_1$. The threshold here may be determined by, for example, subtracting the duration time of $i_1$ and the duration time $i_2$ from the minimum display duration time of the green signal stored in the traffic signal defined value DB 90.

The interpolating portion 104 also performs estimation on estimation sections $i_2$ and $i_3$ between the yellow signal of the current-signal information I2 and the red signal of the current-signal information I3, the signals being of different types. For the estimation section $i_2$, the interpolating portion 104 refers to the minimum display duration time of the yellow signal of the traffic signal S that is recorded in the traffic signal defined value DB 90. For example, when the minimum display duration time of this yellow signal is 3 to 4 seconds, the interpolating portion 104 estimates the display duration time of the yellow signal, which is the sum of the display duration time of the yellow signal of the current-signal information I2 and the time of the estimation section to be three seconds, so that the lighting time of the red signal is increased to secure safety.

For the estimation section $i_3$, when the display duration time of the yellow signal of the estimation section $i_2$ and the display duration time of the red signal of the current-signal information I3 are equal to or lower than the respective thresholds, the interpolating portion 104 estimates that the red signal is continuously displayed during the time of the estimation section $i_3$.

In the estimation described above, the accuracy of estimating the estimation sections can be improved by referring to the alignment information on the road and traffic jam information that are acquired by the GPS 16, the information on each of the other vehicles that is acquired by the radars 18, the information on the traveling conditions of the subject vehicle that is acquired by the sensors 20, and the traveling records of the subject vehicle that are recorded in the driving recorder 80.

The output portion 106 of the signal cycle estimating portion 100 transmits the signal cycle information estimated by the interpolating portion 104 by means of the inter-vehicle communication device 12, to the other vehicles. As a result, the vehicles V1, V2 and V3 forming the vehicle group G can share the interpolated signal cycle information.

According to this embodiment, the road-vehicle communication device 14 receives, from the optical beacon B, the current-signal information on the signal displayed by the traffic signal S at a certain clock time. The inter-vehicle communication device 12 receives, from the other vehicles, the current-signal information on the signal displayed by the traffic signal S at another clock time. The signal cycle estimating portion 100 estimates the signal cycle information of the traffic signal S, based on the current-signal information received by the road-vehicle communication device 14 and the current-signal information received by the inter-vehicle communication device 12. Therefore, the signal cycle estimating portion 100 estimates the signal cycle information based on the signal display information corresponding to two or more clock times. Consequently, the estimation of the signal cycle information can be performed more accurately than estimation performed based on the current-signal information corresponding to one clock time as in the vehicles V0 and V0' shown in FIG. 1.

According to this embodiment, because the information on the signal displayed by the traffic signal S at a clock time other than the clock time at which the current-signal information is acquired is interpolated based on the duration time information, which is the information on the display duration time of each type of signal displayed by the traffic signal S. Therefore, the accuracy of estimating the signal cycle information can be further improved.

Moreover, according to this embodiment, because the inter-vehicle communication device 12 transmits the signal cycle information estimated by the signal cycle estimating portion 100, to the other vehicles, the estimated signal cycle information can be shared by the subject vehicle and the other vehicles.

In addition, according to this embodiment, even when the subject vehicle is a preceding vehicle and when only the current-signal information corresponding to a certain clock time is acquired using the road-vehicle communication, the current-signal information corresponding to a clock time subsequent to the abovementioned certain clock time can be received from the other vehicles that are the following vehicles, and then the signal cycle information can be estimated.

Alternatively, according to this embodiment, even when the subject vehicle is a following vehicle and when only the current-signal information corresponding to a certain clock time is acquired using the road-vehicle communication, the current-signal information corresponding to a clock time preceding the abovementioned certain clock time can be received from the other vehicles that are the preceding vehicles, and then the signal cycle information can be estimated.

While some embodiments of the invention have been illustrated above, it is to be understood that the invention is not limited to details of the illustrated embodiments, but may be embodied with various changes, modifications or improvements, which may occur to those skilled in the art, without departing from the spirit and scope of the invention.

The invention claimed is:

1. A traveling support method, comprising:

receiving first current-signal information relating to a signal displayed by a traffic signal at a first clock time, from a road side transmitter installed on a road;

receiving second current-signal information relating to a signal displayed by the traffic signal at a second clock time, from an other vehicle that receives the second current-signal information from the road side transmitter; and estimating signal cycle information relating to transition of the signal on the traffic signal on the basis of the first current-signal information and the second current-signal information.

2. A traveling support device, comprising:

a road-vehicle communication portion that receives first current-signal information relating to a signal displayed by a traffic signal at a first clock time, from a road side transmitter installed on a road;

an inter-vehicle communication portion that receives second current-signal information relating to a signal displayed by the traffic signal at a second clock time, from an other vehicle that receives the second current-signal information from the road side transmitter; and a signal cycle estimating portion that estimates signal cycle information relating to transition of the signal on the traffic signal on the basis of the first current-signal information received by the road-vehicle communication portion and the second current-signal information received by the inter-vehicle communication portion.

3. The traveling support device according to claim 2, wherein there are a plurality of types of signals displayed by the traffic signal, and the signal cycle estimating portion estimates the signal cycle information by interpolating information relating to a signal that is displayed by the traffic signal at a clock time other than the first clock time and second clock time, on the basis of the first current-signal information, the second current-signal information, and duration time information relating to a display duration time for each of the plurality of types of signals.

4. The traveling support device according to claim 2, wherein the inter-vehicle communication portion transmits the signal cycle information estimated by the signal cycle estimating portion, to the other vehicle.

5. The traveling support device according to claim 2, wherein the inter-vehicle communication portion receives, from the other vehicle which is a following vehicle, the second current-signal information relating to the signal displayed at the second clock time subsequent to the first clock time.

6. The traveling support device according to claim 2, wherein the inter-vehicle communication portion receives, from the other vehicle which is a preceding vehicle, the second current-signal information relating to the signal displayed at the second clock time preceding the first clock time.

7. The traveling support device according to claim 2, wherein the inter-vehicle communication portion further transmits the first current-signal information to the other vehicle.

8. The traveling support device according to claim 2, wherein the inter-vehicle communication portion further transmits the second current-signal information to another vehicle different from the other vehicle.

* * * * *